United States Patent [19]

Mouton, Jr.

[11] 4,341,373

[45] Jul. 27, 1982

[54] HYDRAULIC WELL DERRICK WITH CABLE LIFTS

[76] Inventor: William J. Mouton, Jr., Box 10515, New Orleans, La. 70123

[21] Appl. No.: 80,047

[22] Filed: Sep. 28, 1979

Related U.S. Application Data

[62] Division of Ser. No. 800,486, May 25, 1977, Pat. No. 4,170,340.

[51] Int. Cl.[3] ..... B66D 3/08

[52] U.S. Cl. ..... 254/386; 254/29 R; 254/399

[58] Field of Search ..... 254/386, 392, 399, 29 R, 254/93 R; 175/122; 173/147

[56] References Cited

U.S. PATENT DOCUMENTS 2,415,014 1/1947 Luebbers ..... 254/386 X
2,438,277 3/1948 Fife et al. ..... 254/386
3,474,924 10/1969 Wheeler ..... 254/386 X
3,877,680 4/1975 Childs et al. ..... 254/394

*Primary Examiner*—John M. Jillions
*Attorney, Agent, or Firm*—C. Emmett Pugh

[57] ABSTRACT

As part of a well derrick system using pair of elongated hydraulic cylinders mounted on the derrick face for well pipe elevating, in which an equalizer beam bridges the cylinder ram heads to maintain equality of advance of the rams, the beam being pivoted on a horizontal pivot above the ram heads, the beam carries a lower centrally aligned horizontal pivot sheave means from which cable means extend downwardly to suspend a travelling beam from which depend any of various pipe manipulating tools. In some species additional sheave means on the travelling beam and on an intermediate fixed beam provide for multiple wrappings of the cable means whereby force or distance multiplication may be obtained.

9 Claims, 13 Drawing Figures

HYDRAULIC WELL DERRICK WITH CABLE LIFTS

This application is a divisional of Ser. No. 800,486 filed May 25, 1977, now U.S. Pat. No. 4,170,340 issued Oct. 9, 1979 entitled "Hydraulic Well Derrick With Cable Lifts."

REFERENCE TO RELATED PATENTS

The present application relates to an improvement over an invention claimed in U.S. patent application Ser. No. 622,583, filed Oct. 15, 1975 to William J. Mouton, Jr., now U.S. Pat. No. 4,027,854, said Mouton being the inventor of this improvement.

STATE OF THE ART

The majority of well derrick systems of the past have used foundation-mounted windlasses, with cables leading from the windlass upward over sheaves at the derrick top, thence downward to a hook or tool-holding traveller means; commonly a second set of sheaves was used at the hook, so that force-multiplication was available through the use of multiple passes of the cable between sheaves. In these systems long lengths of expensive cable were needed, cable breakage was common, and broken cables could not further be used.

In the Mason patent, U.S. Pat. No. 2,240,794, there is disclosed a hydraulic cylinder apparatus for a well-drilling lift. The front legs of the derrick, adjacent the well pipe, are enlarged into tubes of considerable diameter, that becomes the cylinders in a pair of hydraulic rams. A piston is positioned in each cylinder, to move downward from the top in response to increase in the hydraulic fluid pressure. Each piston is mounted on a piston "rod", which is actually a set of telescoping tubes, each tube having a packing gland at its lower end, surrounding the tube within it. The smallest tube, adjacent the piston, envelopes closely an elongated cable, which begins at, and is attached to, the piston and extends upward through the tubes, over sheaves at the derrick top, and downward to a hook having spaced cable attachments. Supply of hydraulic fluid to the space within the cylinders above the piston is supposed to press the piston downward, pulling the cable along with the piston, and raising the hook. Apparently, however, the inventor overlooked the fact that the hydraulic fluid is also pressing on the lower end of each piston-rod tube, in the opposite direction to the pressure on the piston, except on the smallest tube, and the available net lifting force would be only that from the area of the smallest tube. It is believed that the system may not be workable. However, if it is workable, it is further believed that the many packing glands at each of the tube ends would be a possible source of significant trouble.

In U.S. Pat. No. 3,877,680, Childs et al. disclose an apparatus called a cylinder synchronizer, designed to be inserted between the main hook depending from the upper sheave of a windlasstype well derrick, and to have conventional drilling fixtures hung on a hook that forms the lowermost part of the apparatus. In this apparatus, two short vertical hydraulic cylinders straddling the well centerline each raise, when extended by application of fluid pressure, a pulley; over the pulley is stretched in inverted U-shape a flexible strap, one end of each strap being attached to the hook below, and each other end to a part of the main frame of the apparatus. Advance of each cylinder causes double the advance of the hook; uneven advance is overcome by automatic tilting of the lower hook, causing a shift of the load to the excessively advanced cylinder.

The Childs et al. apparatus has only short cylinders, and is only an add-on device for insertion on conventional derricks.

SUMMARY STATEMENT OF INVENTION

In well derrick systems for raising, lowering and suspending lengths of well pipe, wherein the changes in elevation are secured through the use of vertical elongated hydraulic cylinders with rams arranged in pairs mounted on a face of the derrick, each member of a pair being parallel to the well centerline, the members being on opposite sides of the centerline and equidistant therefrom, the improvement comprising in cooperative combination the following:

(a) an equalizer beam bridging the heads of the rams, mounted on a horizontal pivot with axis intersecting the well centerline, and the pivot being located above the points of bridging contact between the beam and rams, the beam carrying (b) sheave means comprising at least one sheave on horizontal axis vertically below the said pivot, and (c) cable means carried on said sheave means, and extending downward to and suspending therefrom (d) travelling beam means by which well pipe clamping and working tools may be carried in working fashion.

With rams uppermost, the heads of the rams force upwardly on the underfaces of the equalizer beam, the pivot of which is mounted on trolley means on the face of the derrick, whereby the beam, the trolley means and the upper part of the derrick may be raised by extension of the rams, and the equalizer beam carries sheave means on at least one horizontal axis parallel to the pivot pin and at a lower level. Cable means consisting of at least one set of paralleled cables is strung over said sheave means, one end being attached to the travelling beam, and the other end either to the travelling beam or to the bottom parts of the cylinders.

In a form of the invention, force multiplication is obtained by inserting a cylinder beam bridging the cylinder heads, and carrying additional sheave means, and the travelling beam carries similar sheaves among which several sets the cables are strung.

As means to prevent the rams within the elongated cylinders from scoring and galling, lubricated sleeves are fixed at spaced intervals along the interior of the cylinders, to guide and maintain the ram central alignment within the cylinder.

FIGURES

Figure 6C:
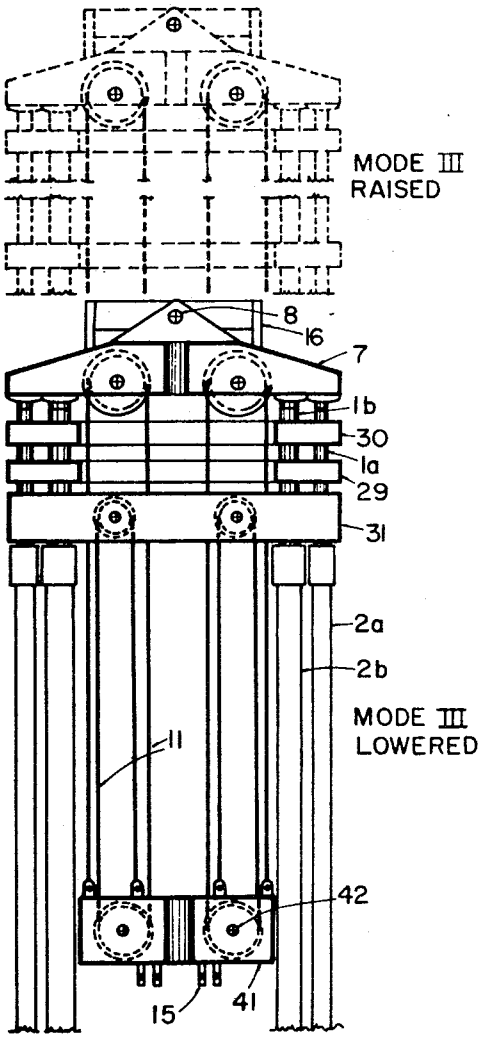
Figure 6B:
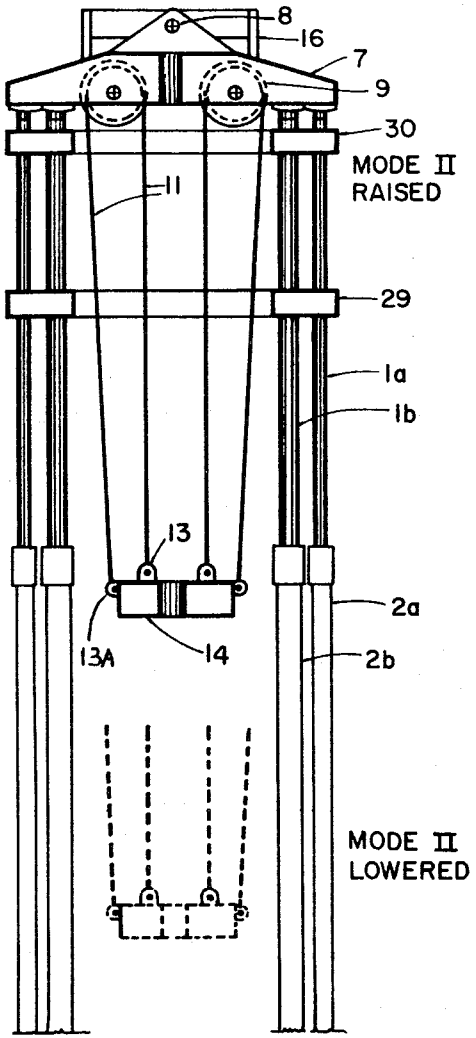
Figure 6A:
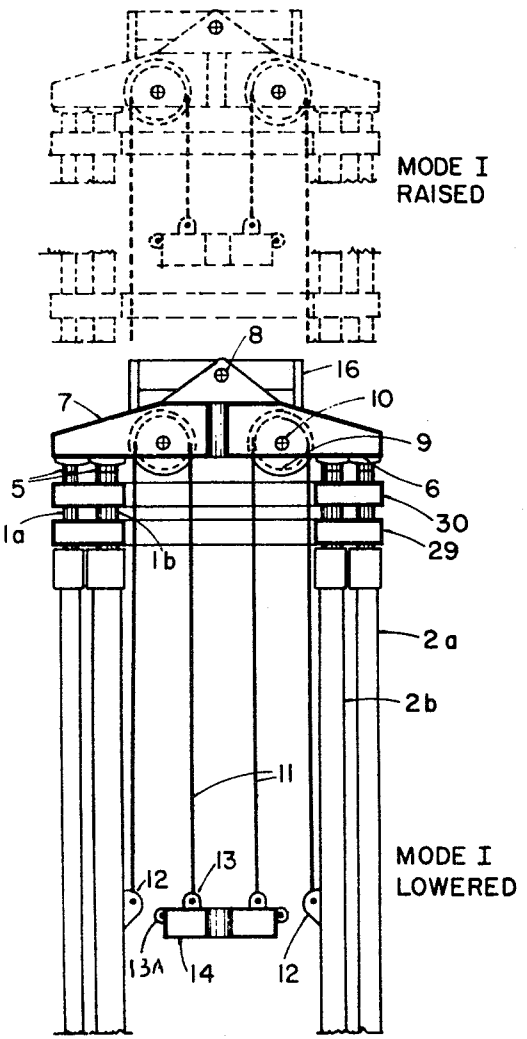

FIGS. 6A–C show three modes of operation of the invention.

Figure 4:
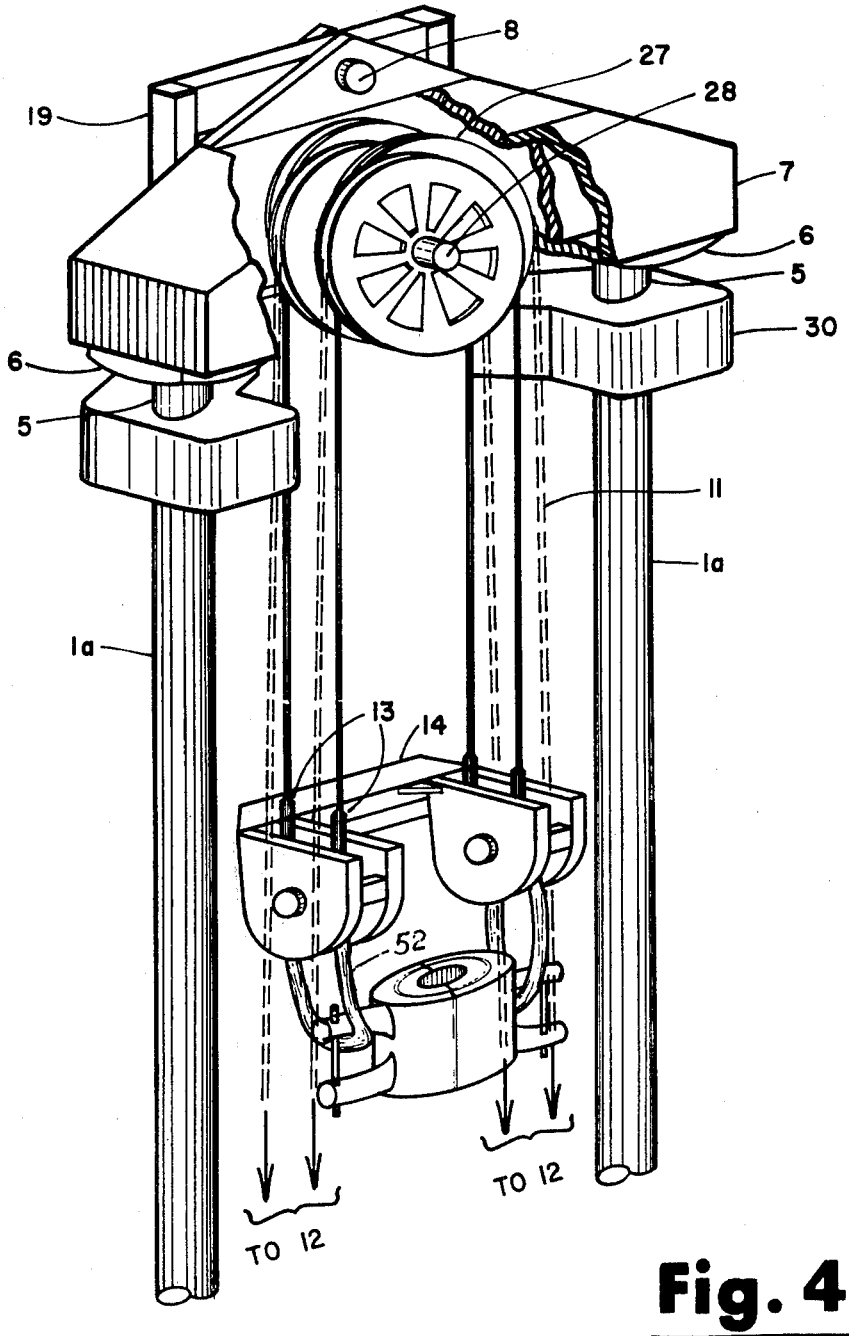
FIG. 4 shows in more detail the head structure of FIG. 3.
Figure 7:
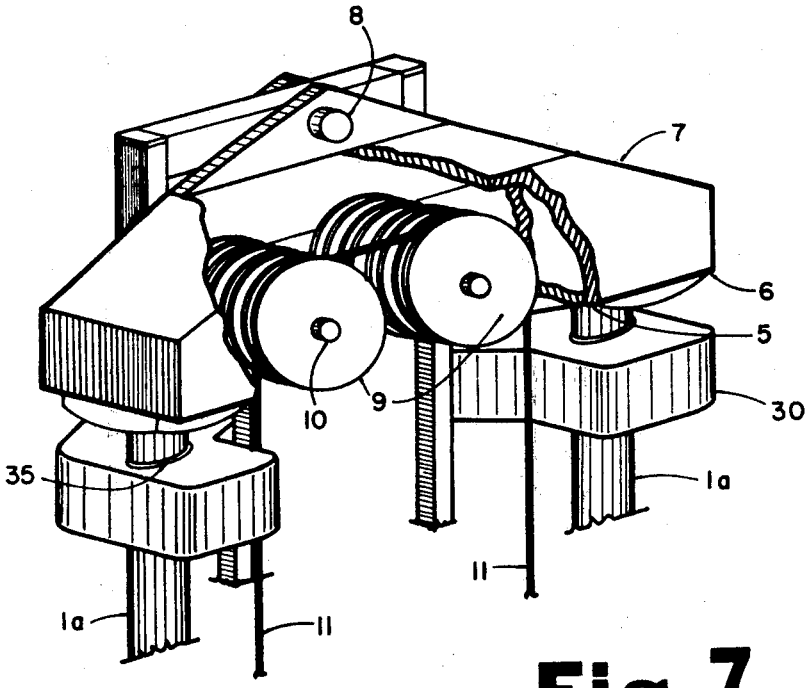
Figure 8C:
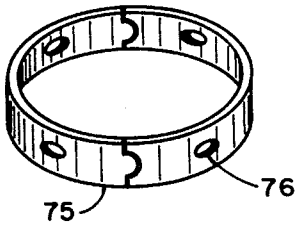
Figure 8B:
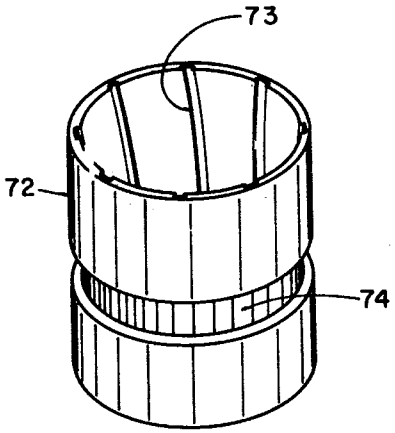
Figure 8A:
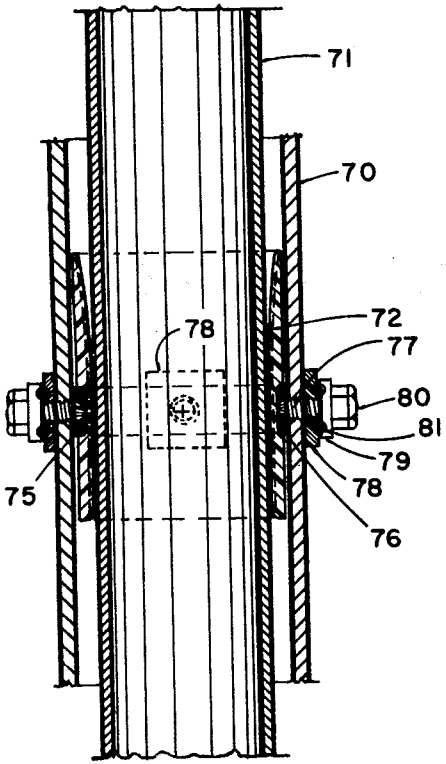

FIG. 7 shows an equalizer beam as an alternative to that in FIG. 4. FIGS. 8A–C show the parts and assembly of a ram guide for use within the hydraulic cylinders.

DETAILED DESCRIPTION OF THE INVENTION

Figure 1:
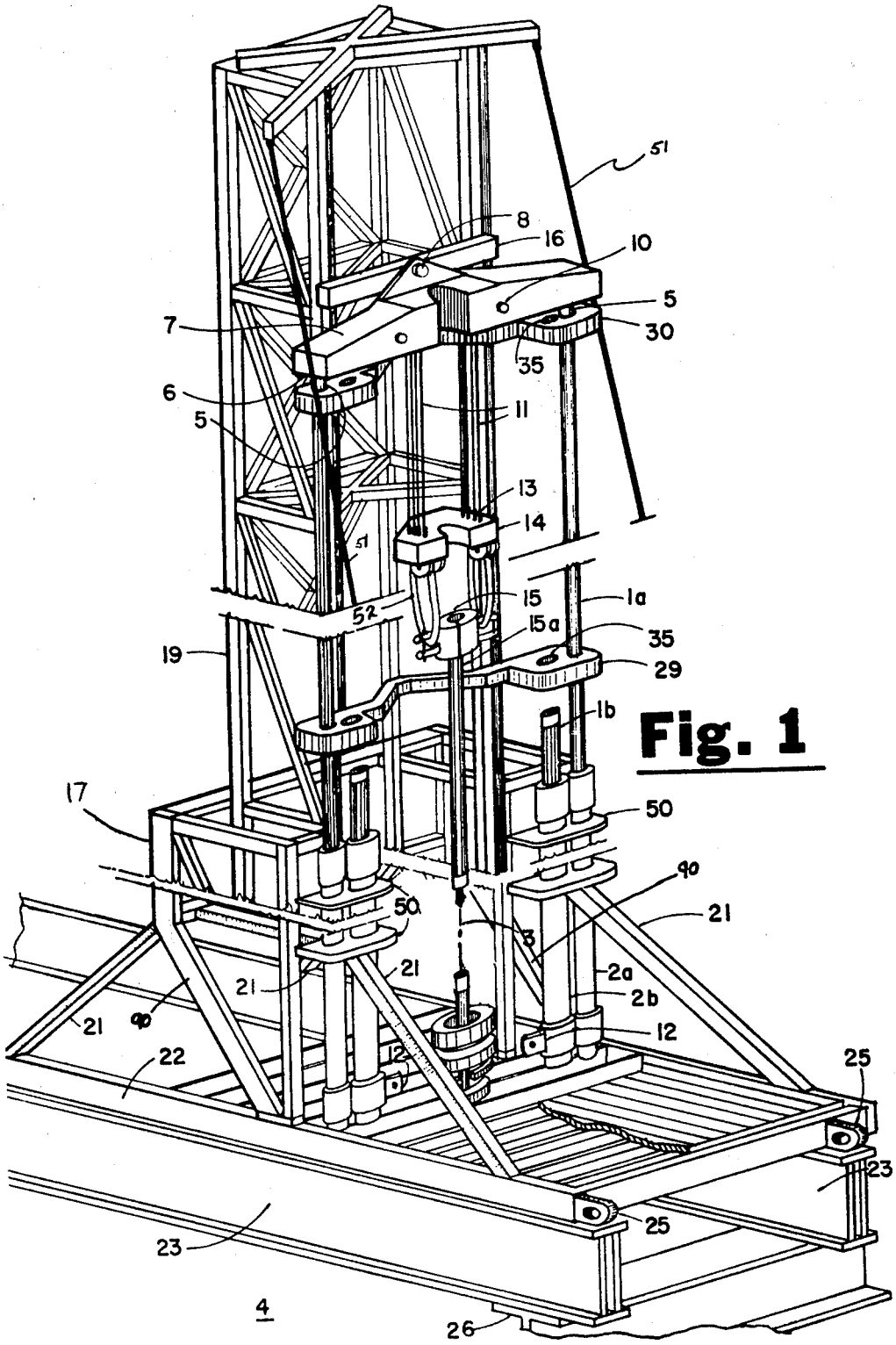
FIG. 1 shows a general view of a well derrick system of the present invention mounted on skid beams, and the skid beams being in turn mounted on a well platform, the system operating according to Mode 1.
Figure 2:
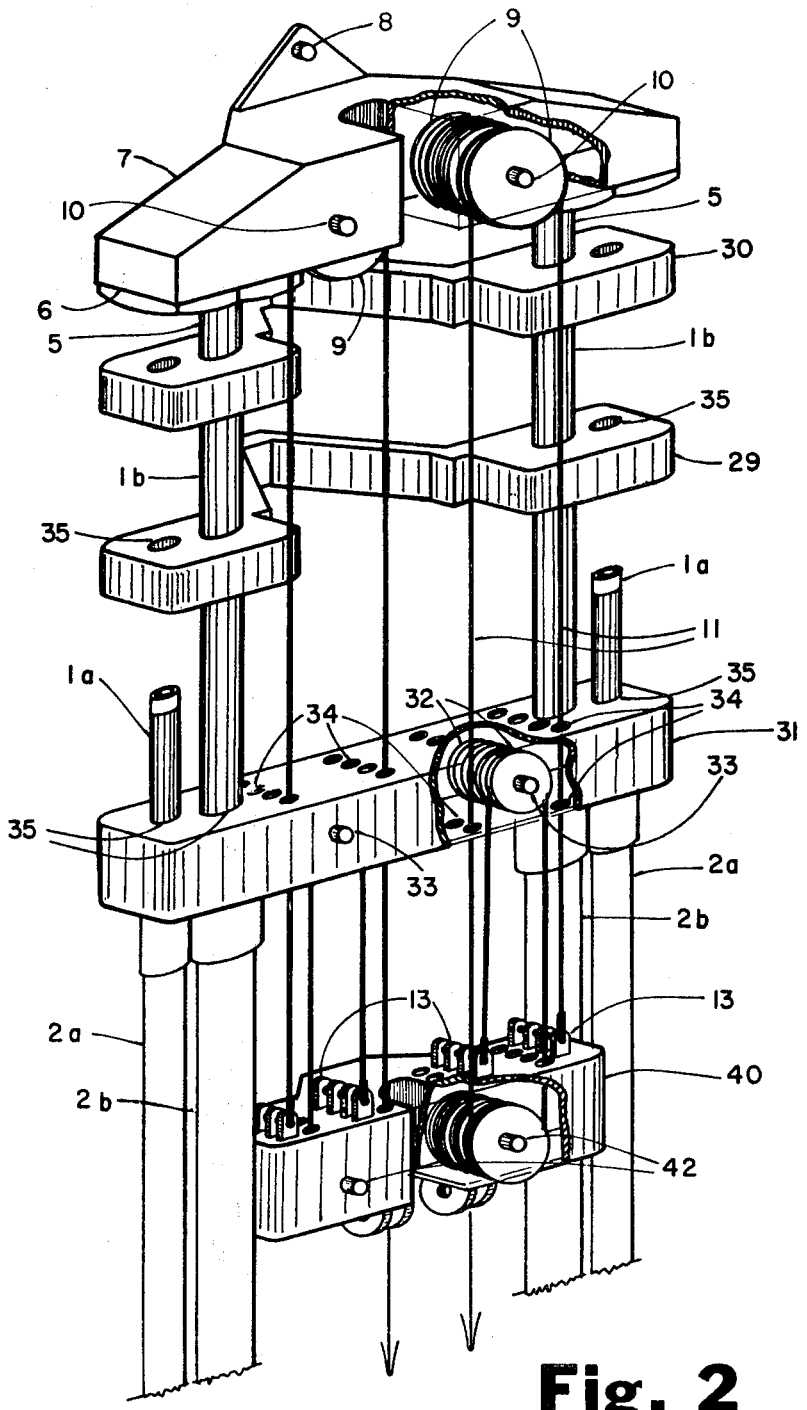
FIG. 2 shows the upper parts of a system operating according to Mode 3.

In the following descriptions, the same or similar items are given the same numerical designation in each of the several views. In FIG. 1 particularly, there is shown a foundation structure 4, above which is mounted a derrick framework comprising an upper derrick 19, and a main derrick 17, the upper derrick being mounted on rollers not detailed within the main derrick 19, whereby the upper derrick may telescope within the main derrick. Means not shown are provided to enable the clamping of the upper derrick at any desired height within the main derrick. The main derrick 17 is attached at its base through diagonal compressive brace members 21 to a set of primary skid beams 22, having lugs 25 by which the primary skid beams may be drawn into any desired location. In the drawing of FIG. 1 the primary skid beams are mounted upon supplemental skid beams 23, which are stretched across the girders 26 of an off-shore drilling platform. In setting up the well drilling apparatus, the skids are pulled into a position surrounding the well centerline 3, so oriented that the centerline extends vertically in front of the center of the derrick's working face, as will shortly become apparent. Hydraulic cylinders 2*a* and 2*b* are arranged in pairs at the outer corners of the derrick's working face, with the cylinder centerlines all being in the same plane as the well centerline. In FIG. 2, it may be seen particularly clearly that the two cylinders labelled 2*a* constitute one pair and the two cylinders labelled 2*b* constitute a second pair, of somewhat larger diameter than the first pair. The bottom ends of each of the cylinders rest upon a cross member in the skid beam structure. The rams 1*a* and 1*b* are forced upward by hydraulic fluid supplied from an undetailed source to the chambers of the cylinders. At or near the bottom of the inner pair of cylinders 2*b* is a pair of lugs 12, by which the lower ends of a set of cables 11 may be fixed. For clarity in presentation, this attachment is detailed only in FIG. 6A, Mode 1 lowered, and is suggested in FIG. 4, where the down-lines of the cables are dotted, and are shown with arrows directed toward lugs 12. Each cylinder is attached at its head and at an intermediate point in its height to the face of the derrick with brackets 50, of sufficient strength to prevent buckling of the cylinder. As previously mentioned the cylinders may be pressured with hydraulic fluid, forcing the rams 1*a* and 1*b* upward, either as an entirety, or in pairs. In FIG. 1, rams 1*a* are shown in extended position, while rams 1*b* are only slightly extended, and are inactive in thrusting. The extended rams are supported against buckling by a lower ram guide 29, and the upper ends are supported by upper ram guide 30, each guide having passages 35 through which the rams may be extended. The upper ends 5 of the extended rams bear against convex underfaces 6 of equalizer beam 7, the general function of which is described and claimed in U.S. Patent Application Ser. No. 622,583, referenced in the introduction hereto now U.S. Pat. No. 4,027,854.

The equalizer beam 7 is supported on a horizontal pivot 8, the centerline of which intersects the well centerline. The pivot is in turn supported on a trolley means 16. The trolley means may run on tracks on the face of the upper derrick 19, these tracks not being detailed but described in some detail in the above-mentioned patent application; alternatively, in some forms of the apparatus, the trolley means may comprise a fixed cross piece on the face of upper derrick as illustrated in FIG. 1, or may be the uppermost structural member of that upper derrick (as in FIG. 3), in which cases raising and lowering of the trolley member is effected by bodily raising and lowering the upper derrick in its supports within the lower derrick.

Also shown in FIG. 1 are two of several brace wires 51, extending downward from the top of the upper derrick to attachment points on the ground, or on the platform, as the case may be.

The heart of the present invention is in the combining of sheaves and cables, in any of several arrangements, with the elongated cylinder lifting system, and the equalizer beam concept for overcoming uneven advance of one cylinder relative to the other in its pair. In the following discussion, each of the variations will be analyzed.

In FIGS. 1 and 2 it is shown that the equalizer beam has two sheave axles 10, one each side of the centerline, and equidistant therefrom. Each of these axles carries a set of sheaves 9, there being enough sheaves so that multiple wraps of cable can have each cable working within its safe operating range of tension. In FIG. 1, four cables are shown hanging down from the under side of the equalizer beam, each side of the centerline, and being attached to the upper side of a travelling beam 14, through attachment lugs 13. Within the equalizer beam, the cables pass around the sheaves, and then extend downward to attachment lugs 12 on the bottom ends of the inner pair of cylinders. For clarity, these cables are not shown in FIG. 1, but are shown in FIG. 6A, Mode 1, lowered. Thus cabled, hydraulic raising of one or more pairs of rams 1*a* and 1*b* will raise the equalizer beam and its sheaves, in turn raising the travelling beam 14 by twice the distance that the rams rise. The travelling beam in turn lifts the elevator bails 52, the well-pipe handling tools 15, and the pipe 15*a*. In Mode 1, since one end of the cable attaches to the cylinder base at 12, the maximum lift available at the travelling beam is one half the maximum ram force.

In Mode 2, shown in FIG. 6B, the lift is doubled in strength, but halved in distance, which for many situations is a desirable manner of operating. The change from Mode 1 to Mode 2 is achieved very simply, by switching the outer ends of the cables from attachment to lugs 12 over to lugs 13*a* on the travelling beam. After this switch, both ends of each suspending cable are attached to the travelling beam 14, and the whole force exerted by the rams is applied to the lift. All of the advantages of the equalizer beam technique are available for causing uneven advance of the rams to be compensated, as taught in the referenced patent application, together with the much greater flexibility ensuing from the novel use of sheaves and cables for transferring the lifting forces from the rams.

Figure 5A:
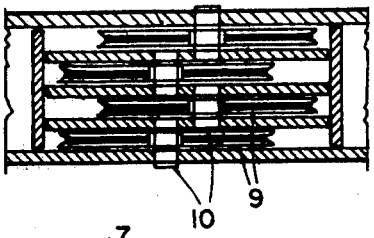
FIG. 5A is a plan view of the sheaves of FIG. 5.
Figure 5:
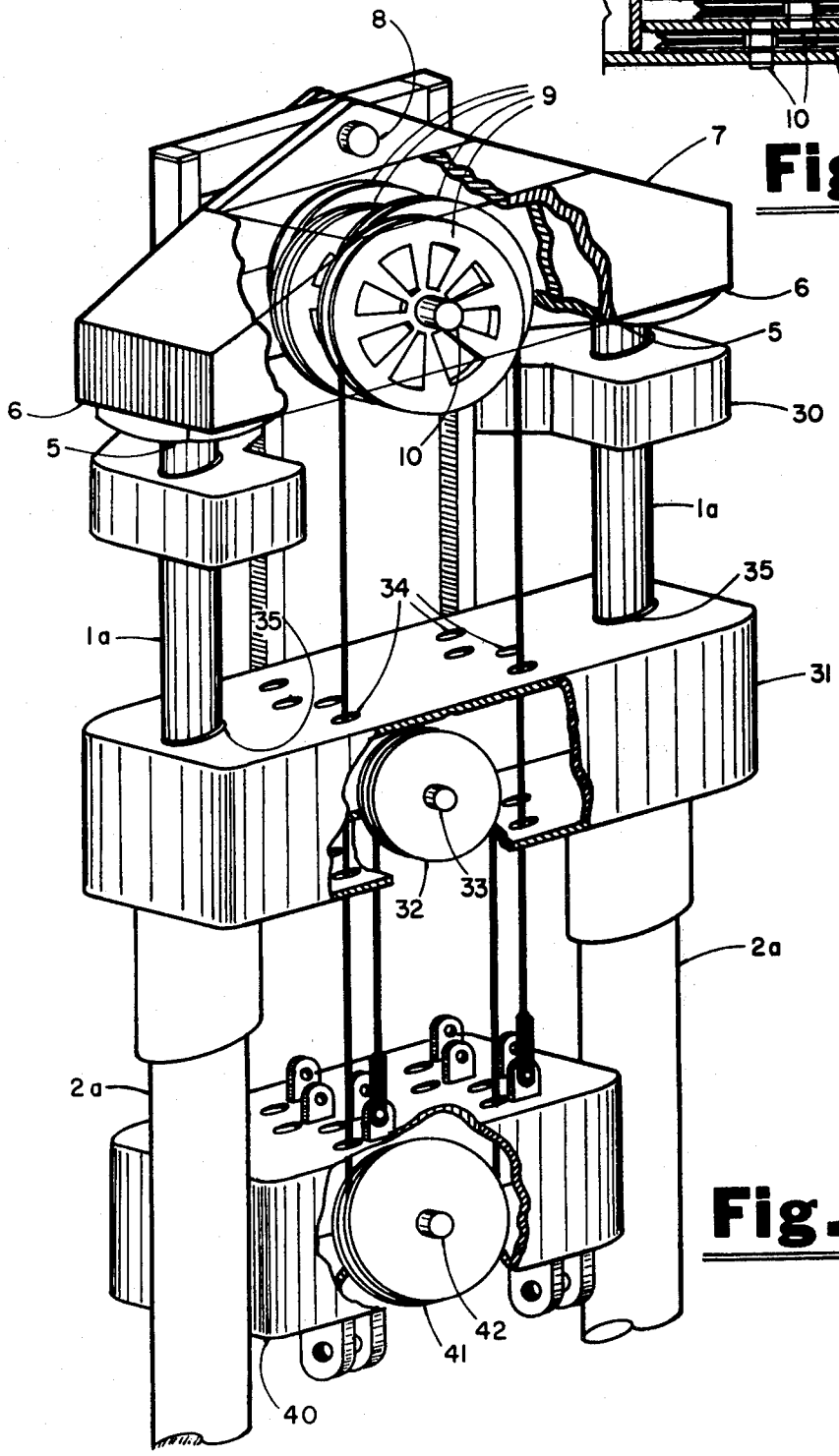
FIG. 5 shows in detail the head structure of a system operating according to Mode 3.

Another degree of convenience is added by the arrangement shown in FIG. 6C, Mode 3, and detailed in two slightly varying arrangements in FIGS. 2 and 5. For this mode a cross member 31 carrying sheaves 32, and called a cylinder beam, is inserted into the apparatus to bridge across from the cylinder heads on one side to the cylinder heads on the other side. Passages 35 are provided for the rams to rise upward, and passages 34 for cables to be strung through the cylinder beam. As can be seen especially easily in FIG. 6C, Mode 3, one end of a cable is attached to a lug on the travelling beam, whence the cable extends upward through a passage in the cylinder beam, then around a sheave on the equalizer beam, thence back downward through the passage in the cylinder beam, around a sheave in the travelling beam, upward around a sheave in the cylinder beam, and finally, downward to a second lug on the travelling beam. As indicated by the multiplicity of sheaves and passageways, normally several cables will be used in parallel, thereby enabling the use of smaller, less expensive cables. The share of the total load of the travelling beam assumed by any cable is further subdivided into the several passes of each cable. In the example shown in FIG. 2, the two cables each take half the load, but because each cable has four passes to the travelling beam, each pass has only one eighth of the load.

The particular advantage of the use of Mode 3 is that the cylinder beam transfers half the total load directly to the tops of the cylinders, which in turn, both through longitudinal compression of the cylinder walls (in opposition to the longitudinal tension), and through opposition by the pressurized hydraulic fluid in the cylinders, thereby transfer this half of the load to the cylinder bottoms, and thence to the foundations of the structure. Accordingly, the travelling beam load is not applied to the derrick, and the derrick's function is to supply stiffening strength to the apparatus, and trackage for the telescoping of the upper derrick and/or for the trolley beam, if any is used.

FIG. 1 shows a means for transferring the loads from the cylinder bottoms to the foundation structure in such a way as to distribute the load over a large area, and to minimize the problems, especially important with offshore platforms, of providing girders to accept the well drilling loads. In such platforms, the span of the girders 26 may commonly be as much as 40 feet, and for the greater-than-100 ton loads encountered with normal drilling practice, the bridging girders 23 will require a web height of as much as 5 feet.

Figure 3:
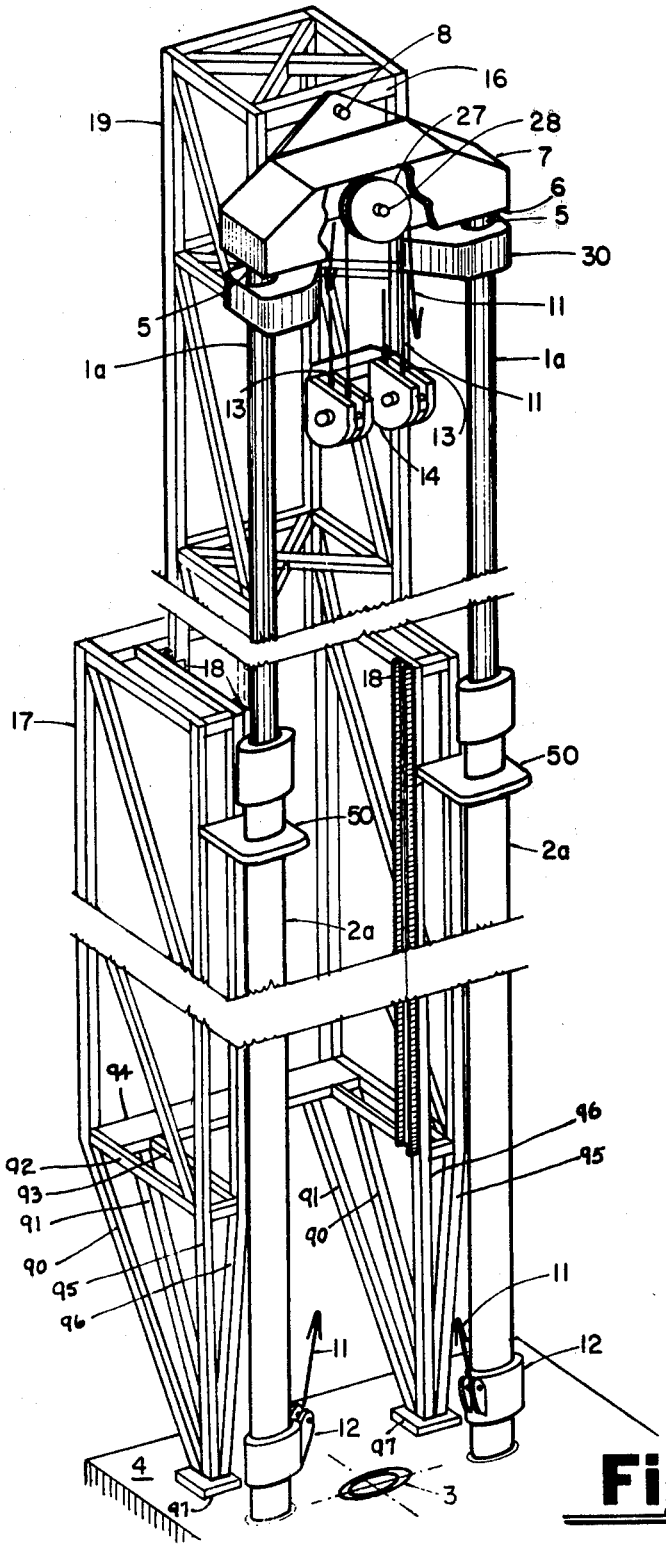
FIG. 3 shows a species according to Mode 1, in which the derrick has an upper truss telescoping into a lower truss.

Applicant, however, has devised a derrick base construction which considerably lightens the girder requirements, by spreading the load from the direct bottom of the derrick out to points on the girder 23 not far from directly above the platform girders 26 in FIG. 1. In FIG. 3, it is seen that the lower members of the bottom derrick 17, being members 90, 91, 95, and 96, all converge to a bottom pad 97, there being one such pad under both the sides of the derrick. In the relatively light duty structure shown in FIG. 3, which uses only a single pair of cylinders, the lifting loads are carried back directly through the cylinder bottoms to the base platform foundation structure 4. In this instance the main load on pads 97 is the weight of the lower derrick, only.

In the heavy duty structure of FIG. 1, where multiple cylinders are used, and a cylinder beam 29, together with the multiple sheaving and cabling are used to enable lifting of very heavy loads, these massive loads would be concentrated under the bottoms of the cylinders, were it not for applicant's improvement. Applicant converts the bottom part of lower derrick 17, together with the primary skid beam 22 into parts of a typical bridge truss, by extending the diagonal members 21 down to widely spaced points on the skid beam 22. On the front of the derrick, as seen in FIG. 1, diagonals 21 extend downward from just under the cylinder tying brackets 50, to the skid beams 22. Behind the cylinders, the lower members of the lower derrick 17 are tied into triangular array so as to satisfy the structural requirements for a statically determinate bridge truss, which truss is completed by the attachment of the upper ends of the rear diagonals 21 to the upper ends of members 90. With this construction, members 21 are in pure compression, and pass on the entire cylinder load, as received at brackets 50 to the widely spaced points on skid beam 22, which is now in tension. As operated in Mode 3, the cylinder above bracket 50 is in compression from the load applied by the cylinder beam 29, and this compression, is applied directly to bracket 50; below 50, the cylinder is in tension, being pushed down from bracket 50 by its internal fluid pressure, although being pulled up by the cables attached to lugs 12.

In FIGS. 1 and 2, the equalizer beam 7 is shown to have two sets of sheaves, one set to the left of the well centerline, and one set to the right. A notch is provided in the beam between the two sets of sheaves, to provide a space for the upper part of a long length of well pipe to fit. This form of equalizer beam is particularly suited to the apparatus when the beam is mounted on a trolley means 16 that rolls up and down the face of the upper derrick 19, whence the beam may be in low positions where the pipe clearance is more often necessary.

In FIG. 3, the equalizer beam is attached to the upper edge of the upper derrick, which then becomes in effect, the trolley means. In this case the beam need not be notched, and it is accordingly provided with only a single set of sheaves, with centerline directly below the equalizer pivot pin 8. The sheaves are of sufficient diameter that the cables depending from them to the travelling beam have the spread required at the travelling beam.

In FIGS. 4 and 5, a variation of the sheave structure in the equalizer beam is shown. This variation may be needed in some instances where the spread of the attachment points on the travelling beam is so great that the sheaves of that same diameter as the spread would be inconveniently large, and for this variation, sheaves of smaller diameter are used, and their centerlines are not separated enough to provide through passage for the axle pins. In this variation pivot plates are set in in sandwich form between the sheaves, and very short pins are used, as shown in the inset drawing on FIG. 5.

In FIG. 7 is shown another variation of the equalizer beam construction, in which the sheaves are completely separated as they are in FIG. 1, but the notch is not included, making it then possible to string the cables directly across from the one set of sheaves to the other.

In FIGS. 1, 2, 3, and 4, the travelling beam 14 is shown to have a notch to enable it to spread around the section or sections of pipe that are being grasped by the work-handling tools hung below the beam. In some situations this encircling ability may not be necessary, in which case the travelling beam of FIG. 5 can be used. This beam has no notch, but the central space is occupied by a set of sheaves 41, on horizontal axle 42. With this travelling beam there may be used a different variation of the cylinder beam, as seen in FIG. 5. This cylinder beam has instead of two spaced apart sets of sheaves as in FIG. 2, only a single set of sheaves centrally located, as seen in FIG. 5.

In applications of elongated hydraulic rams with cylinders in well drilling and well working derricks as taught in this application and as taught in Application Ser. No. 622,583, filed Oct. 15, 1975 to William J. Mouton, Jr., (now U.S. Pat. No. 4,027,854) it is desirable that the portions of rams within the cylinders at any and all degrees of extension be supported at spaced locations along their length, in order that the rams may be prevented from rubbing against the interior surfaces of the cylinders. Such rubbing would cause scoring of the surface of the ram, and such scoring would make difficult or even impossible the retention of hydraulic fluid in the seal around the ram as it exits the cylinder.

In order to prevent such scoring, and to maintain the ram in central alignment within the cylinder, applicant has designed and tested the cylinder insert shown in FIG. 8. This insert comprises a tubular sleeve 72, with inside diameter to let the ram 71 pass loosely, and outside diameter to enable the sleeve to be slid readily into a location along the length of the interior of cylinder 70 where interior support is desired. The sleeve may be constructed of some self-lubricating material, such as nylon or nylon containing graphite or molybdenum disulphide. Preferably the upper side of the sleeve should have a generally conical entrance for the ram, and grooves 73 are provided through the interior to enable the passage of hydraulic fluid between upper and lower parts of the cylinder. In order to secure the sleeve in its desired location within the cylinder, the sleeve is provided with a shallow peripheral groove 74, and a two-part split ring 75 is provided, which is thin enough to bottom into the groove, with an outside diameter just enough smaller than the cylinder inside diameter, that the assemblage of sleeve and split ring may be pushed to the desired location within the cylinder.

At the desired location on the cylinder, a set of bosses 78 are provided on the outer surface of the cylinder, each boss having a flat outer surface, and being provided with a threaded hole, penetrating through the boss, and through the cylinder within. Holes 76 are also provided in the retaining ring, in locations that can be made to line up with the holes in the bosses. The flat faces are also preferably provided with O-ring retaining grooves. A short bolt 77 is provided for each boss, with bolt head adapted to cooperate with the boss to retain and compress an O-ring 81 in sealing engagement in the groove; this bolt should be just long enough to go through the wall of the cylinder and to penetrate into the split ring holes, but short enough not to touch the surface of the sleeve.

In the previous paragraphs my invention has been disclosed in considerable detail, and several different forms have been described, from which the spirit of the invention should be apparent. I desire not to be limited by the specific detail, but rather by the limitations as expressed in the following claims.

What I claim is:

1. In a well derrick system for raising, lowering and suspending lengths of well pipe, wherein the changes in elevation are secured through the use of vertical, elongated hydraulic cylinders with rams arranged in pairs mounted on the face of the derrick, each member of a pair being parallel to the well's centerline, the members being on opposite sides of the centerline and equidistant therefrom, the improvement comprising in cooperative combination the following:

(a) an equalizer beam bridging the heads of the rams, mounted on a horizontal pivot having an axis intersecting the well centerline, the pivot being located above the points of bridging contact between the beam and the rams, the beam carrying (b) sheave means comprising at least one sheave on a horizontal axis below the said pivot, and (c) cable means carried on said sheave means, and extending down to and suspending therefrom (d) travelling beam means for carrying wellpipe clamping and working tools in working fashion, the cable means comprising two cable sets, each cable having two ends, and the equalizer beam carrying two sets of sheaves on horizontal axes below and parallel to the pivot, and spaced apart from one another equidistantly from the well centerline, one of the cable sets being strung over one of the sets of sheaves, and the other set of sheaves holding the other cable set, and (e) at least one pair of hydraulic cylinders mounted on the derrick with their rams uppermost, said cylinders being supported near their bottoms on a foundation structure, the upper ends of each ram of a pair that is in use forcing upwardly against the under faces of said equalizer beam, and (f) diagonal truss members coupled to the cylinders extending downwardly from brackets attached to the cylinders to spaced points on the foundation structure, forming with any intervening derrick structure a bridge truss type structure, whereby the cylinder loads are transferred away from the cylinder bottoms.

2. The improvement of claim 1, in which at least one cable is attached at one end to said travelling beam means, and at the other end to an attachment point on one of said cylinders.

3. The improvement of claim 1, in which at least one cable has both of its ends attached to said travelling beam means.

4. The modification of claim 1, in which a single cable is used for both cable sets, the one cable being strung across both sets of sheaves.

5. The improvement of claim 1, in which the ends of the cables in each set are connected respectively between said travelling beam means and attachment points on said cylinders.

6. The improvement of claim 1, in which both ends of each cable in each set are attached to said travelling beam means.

7. The modification of claim 1, in which said two sets of sheaves, on two sheave axes, are positioned to overlap and interdigitate with one another.

8. The modification of claim 1, in which a cylinder beam is included, bridging across the heads of the cylinders and supported thereon, and carrying at least one set of sheaves, said travelling beam means carrying a similar number of sheaves, and the sets of cables being strung among the sets of sheaves to achieve an additional multiplication of force.

9. The modification of claim 1, in which a cylinder beam is included, bridging across the heads of the cylinders and supported thereon, and carrying one set of sheaves, the travelling beam means carrying a similar set of sheaves, and the sets of cables being strung among the sets of sheaves to achieve an additional multiplication of force.

* * * * *